US006350016B1

(12) United States Patent
Tachihara et al.

(10) Patent No.: US 6,350,016 B1
(45) Date of Patent: Feb. 26, 2002

(54) LIQUID EJECTING METHOD AND LIQUID EJECTING HEAD

(75) Inventors: Masayoshi Tachihara, Chofu; Yasuyuki Tamura, Yokohama; Shuichi Murakami, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/245,043

(22) Filed: Feb. 5, 1999

(30) Foreign Application Priority Data

Feb. 10, 1998 (JP) ..... 10-028879

(51) Int. Cl.[7] ..... B41J 2/05
(52) U.S. Cl. ..... 347/56; 347/61
(58) Field of Search ..... 347/65, 54, 56, 347/57, 44, 47, 20, 61, 45

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,646,105 A | * | 2/1987 | Matsumoto et al. | 347/57 |
| 4,723,129 A | | 2/1988 | Endo et al. | 347/56 |
| 4,740,796 A | | 4/1988 | Endo et al. | 347/56 |
| 4,980,703 A | * | 12/1990 | Sakurai | 347/63 |
| 5,159,354 A | | 10/1992 | Hirasawa et al. | 347/65 |
| 5,574,488 A | | 11/1996 | Tamura | 347/63 |
| 5,924,197 A | | 7/1999 | Murakami et al. | 29/890.1 |
| 5,933,164 A | * | 8/1999 | Sato et al. | 347/43 |
| 5,984,457 A | * | 11/1999 | Taub et al. | 347/56 |
| 6,076,919 A | * | 6/2000 | Shirota et al. | 347/60 |
| 6,155,673 A | * | 12/2000 | Nakajima et al. | 347/61 |

FOREIGN PATENT DOCUMENTS

| | | |
|---|---|---|
| EP | 0 641 654 | 3/1995 |
| EP | 195 05 465 | 8/1995 |
| EP | 0 925 930 | 6/1999 |
| JP | 79-056847 | 5/1979 |
| JP | 84-123670 | 7/1984 |
| JP | 84-138461 | 8/1984 |
| JP | 85-071260 | 4/1985 |
| JP | 4-10940 | 1/1992 |
| JP | 4-10941 | 1/1992 |
| JP | 4-10942 | 1/1992 |
| JP | 5-016365 | 1/1993 |

* cited by examiner

*Primary Examiner*—John Barlow
*Assistant Examiner*—Blaise Mouttet
(74) *Attorney, Agent, or Firm*—Fitzpatrick Cella Harper & Scinto

(57) ABSTRACT

A liquid ejecting method using a liquid ejecting head having electrothermal transducer elements for generating thermal energy sufficient to create bubbles in liquid and ejection outlets disposed opposed to the electrothermal transducer elements which are arranged at a density not less than 300 per 25.4 mm in a line, the liquid ejection head also having liquid flow paths in fluid communication with the ejection outlets, respectively, wherein the bubble generated by the thermal energy generated by the electrothermal transducer element is brought into communication with ambience while an internal pressure of the bubble is less than an ambient pressure, and wherein droplets having volumes not more than $15\times10^{-15}$ $m^3$ are ejected at a frequency not less than 7 kHz, said method includes the improvement wherein the liquid flow path of the liquid ejecting head has a height not less than 6 $\mu$m, and a distance between an upper surface and a lower surface of the ejection outlet is not more than one half of a minimum opening distance through a center of the ejection outlet.

29 Claims, 5 Drawing Sheets

(a)

(b)

(a)

(b)

LIQUID EJECTING METHOD AND LIQUID EJECTING HEAD

FIELD OF THE INVENTION AND RELATED ART

The present invention relates to a liquid ejecting method and a liquid ejecting head which are used for ejecting droplets of liquid such as ink toward various recording media, such as paper, for the purpose of recording. In particular, it relates to a liquid ejecting method for ejecting extremely small droplets of liquid at an extremely high frequency, and also, a liquid ejecting head, that is, a recording head, which comprises a plurality of liquid paths arranged at a high density to realize high resolution.

Among various liquid ejecting methods are so-called bubble jet type liquid ejecting methods. According to these methods, bubbles are rapidly grown in liquid, and the pressure generated by the bubble grown is used to eject droplets of liquid from liquid ejection orifices. These methods are high in liquid ejection response, and therefore, are excellent for high speed recording and high density recording.

Among the bubble jet type liquid ejecting methods are liquid ejection methods which allow a bubble generated on a heat generating member to open to the atmosphere at the edge of an ejection orifice. As for such methods, Japanese Laid-Open Patent Application No 10940/1992, 10941/1992, 10742/1992, and the like, are well known.

These methods have following characteristics. First, they can increase liquid ejection velocity, and therefore, can increase reliability. Secondly, they can eject substantially the entire liquid present between a heat generating member and an ejection orifice, and therefore, can unify the volume by which liquid is ejected each time, which in turn reduces irregularity in terms of the image density.

As recording technologies progress, it has come to be required to record extremely high quality images, that is, to deposit liquid droplets of an extremely small volume (for example, $1.5\times10^{-10}$ $m^3$ or less) on recording medium at an extremely high density (for example, 600 dots/25.4 mm or more). In order to record such highly precise images, ejection orifices, and liquid paths leading to the ejection orifices, must be arranged at an extremely high density. For example, in order to accomplish the aforementioned recording density of 600 dots/25.4 mm, the ejection orifices must be aligned in two parallel lines, at a density of 300 unit/25.4 mm, the units in one line being displaced by half a pitch from the units in the other line in the line direction.

Recording an image with the use of finer liquid droplets increases the number of liquid droplets to be ejected, which in turn reduces recording speed. In order to prevent this recording speed reduction, it is necessary to increase the frequency at which liquid droplets are ejected from each ejection orifice per unit of time (hereinafter, "ejection frequency"). For example, in the case of the structure described above, the ejection frequency must be at least 7 kHz.

Further, in order to record a high quality image by ejecting liquid droplets with a volume as small as the one described above, the reliability with which liquid droplets are ejected must be improved.

As described above, there are bubble jet type liquid ejecting method which allow bubbles to become connected to the atmosphere. For example, Japanese Lair-Open Patent Application No. 16365/1993 discloses a technology regarding the state of a liquid droplet at the time of ejection, and the condition for allowing a bubble to become connected to the atmosphere.

When a bubble jet type liquid ejecting method which allows a bubble to become connected to the atmosphere was applied to an ink jet head which ejected extremely small liquid droplets with a volume of $1.5\times10^{-10}$ $m^3$, it was confirmed that during a recording operation, liquid droplets suddenly failed to be ejected from some of the ejection orifices through which liquid droplets had been properly ejected. This phenomenon was different from the ejection failure which occurred to the prior liquid ejecting heads. The investigation of this phenomenon revealed the following. That is, recording liquid suddenly plugged the ejection orifices during the period between the time when a bubble became connected to the atmosphere and the time when the refilling ended. Thereafter, recording liquid could not be ejected from the plugged ejection orifices unless a recovery operation was carried out with the use of the recovery mechanism of the main assembly of an image forming apparatus.

FIG. 5 is a section of a liquid ejection orifice, and a liquid path leading to the orifice, which depicts the above described phenomenon. As is evident from FIG. 5, immediately after a bubble becomes connected to the atmosphere and a droplet of recording liquid 501 is ejected, an ejection orifice is plugged with recording liquid 501. At this point of time, there also remains recording liquid 501 in the ink supply path. However, there is no recording liquid adjacent to an electrothermal transducer 1, because it is immediately after liquid ejection. In other words, there is only atmospheric air 502 adjacent to the electrothermal transducer 1. In this state, even if an electrical pulse is applied to the electrothermal transducer 1, a droplet of recording liquid 501 cannot be ejected, since there is no recording liquid 501 around the electrothermal transducer 1. Therefore, it is impossible to unplug the ejection orifice 4.

Further, during the development of the present invention, it became evident that when the aforementioned type of head, in which a large number of liquid paths were disposed at a high density, was driven at a high frequency, attention must be paid to the state of the meniscus after a bubble became connected to the atmosphere, in particular, how the state of the meniscus after the connection is different from the state of the meniscus prior to the connection. Thus, the object of the present invention is to provide a reliable liquid ejection method, that is, a liquid ejecting method which does not suddenly fail to eject liquid, i.e., a liquid ejecting method which makes high speed recording possible with the use of a bubble jet type liquid ejecting head, in particular, so-called side shooter type liquid ejecting head in which ejection orifices for ejecting extremely small liquid droplets at a high frequency are disposed at a high density, directly facing heat generating members one for one, and in which a bubble is allowed to become connected to the atmosphere.

SUMMARY OF THE INVENTION

The gist of the present invention for accomplishing the above-described object of the present invention is as follows.

The liquid ejecting method in accordance with the present invention uses a liquid ejecting head which comprises a plurality of electrothermal transducers capable of generating a sufficient amount of thermal energy for generating bubbles in liquid, a plurality of ejection orifices disposed directly facing the electrothermal transducers one for one, and a plurality of liquid paths. The ejection orifices are aligned at a density of no less than 300 per 25.4 mm, and are connected to the liquid paths one for one. This liquid ejecting method is characterized in that bubbles generated by the thermal energy generated by an electrothermal transducer eject droplets of liquid with a volume of no more than $15\times10^{-15}$ $m^3$, one for one, at a frequency of no less than 7 kHz, and open to the atmosphere as they eject the liquid while their internal pressure is below the atmospheric pressure, and that the height of the liquid path in the liquid ejecting head is no less than 6 $\mu$m, and the distance between the top and bottom openings of the ejection orifice is no more than half the minimum distance across the ejection orifice through the center of the orifice.

The liquid ejecting head in accordance with the present invention comprises a plurality of electrothermal transducers capable of generating thermal energy for generating bubbles in liquid, a plurality of ejection orifices disposed directly facing the electrothermal transducers one for one, and a plurality of liquid paths. The ejection orifices and liquid paths are aligned at a density of no less than 300 per 25.4 mm. To the electrothermal transducers, driving signals are applied at a frequency of no less than 7 kHz. This liquid ejecting head is characterized in that bubbles are generated in the liquid paths, and eject droplets of liquid with a volume of no more than $15\times10^{-15}$ $m^3$, one for one, opening to the atmosphere as they eject the liquid while their internal pressure is below the atmospheric pressure, and that the height of the liquid path is no less than 6 $\mu$m, and the distance between the top and bottom openings of the ejection orifice is no more than half the minimum distance across the ejection orifice through the center of the orifice.

Further, the liquid ejecting method in accordance with the present invention uses a liquid ejecting head which comprises a plurality of electrothermal transducers capable of generating a sufficient amount of thermal energy for generating bubbles in liquid, a plurality of ejection orifices disposed directly facing the electrothermal transducers one for one, and a plurality of liquid paths. The ejection orifices are aligned at a density of no less than 300 per 25.4 mm, and are connected to the liquid paths one for one. The bubbles generated by the thermal energy generated by an electrothermal transducer eject droplets of liquid with a volume of no more than $15\times10^{-15}$ $m^3$, one for one, at a frequency of no less than 7 kHz, and open to the atmosphere as they eject the liquid while their internal pressure is below the atmospheric pressure. This liquid ejecting method is characterized in that it comprises a process in which the liquid which remains within the ejection orifice after the bubble opens to the atmosphere, remains in connection to the liquid in the liquid path which retracts away from the ejection orifice, and a process in which the liquid remaining in the ejection orifice joins with the liquid in the liquid path, and refills the ejection orifice.

With the provision of the above described structure, the ejection orifices in a side shooter type liquid ejecting head in which bubbles open to the atmosphere are not plugged with recording liquid. Consequently, the appearance of the unwanted white lines during recording, for which the sudden ejection failure of some of the ejection orifices is responsible, is reliably prevented, making it possible to reliably print high quality images at a high speed.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1, (*b*) is a section of the liquid ejecting head in FIG. 1, (*a*), at a line A—A, and depicts the general structure of the head.

FIG. 2, (*b*) is a top view of the essential portion of the liquid ejecting head illustrated in FIG. 2, (*a*).

DESCRIPTION OF THE PREFERRED EMBODIMENTS

Embodiment 1

Figure 1:
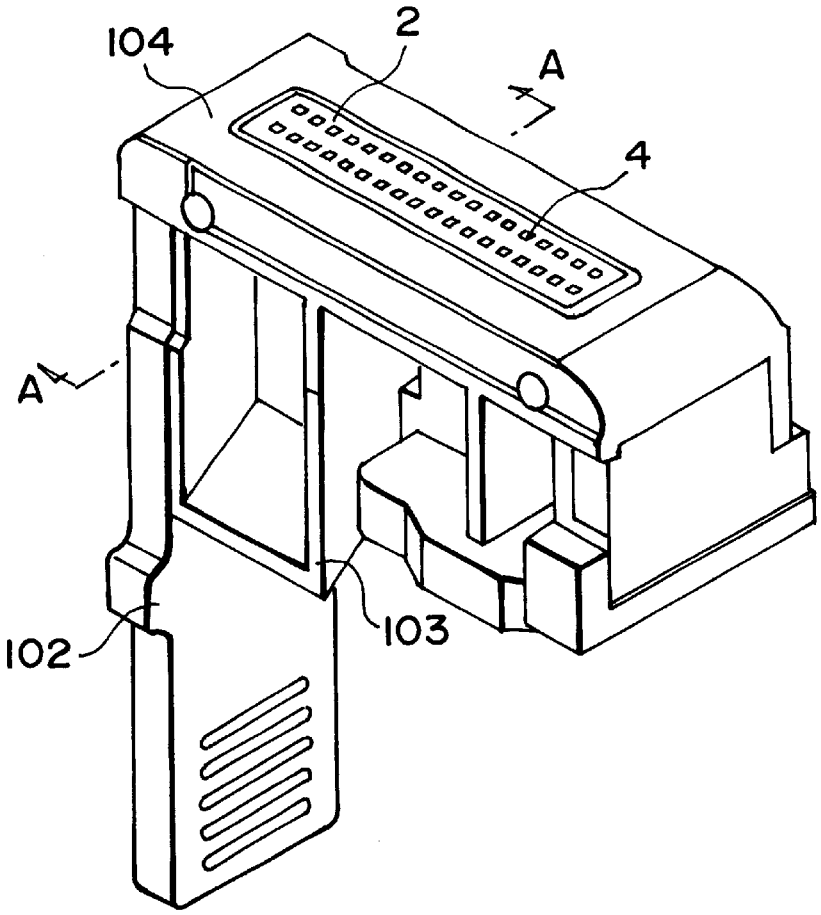
FIG. 1, (*a*) is an external perspective view of a liquid ejecting head to which the liquid ejecting method in accordance with the present invention can be applied, and depicts the general structure of the head.
Figure 1:
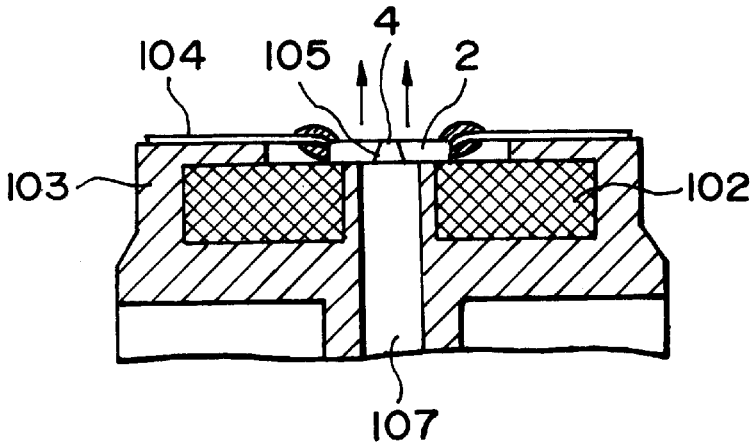

FIG. 1, (*a*) is an external perspective view of a liquid ejecting head to which the liquid ejecting method in accordance with the present invention can be applied, and depicts the general structure of the head. FIG. 1, (*b*) is a section of the liquid ejecting head in FIG. 1, (*a*), at a line A—A, and depicts the general structure of the head. In FIG. 1, a referential code 2 designates a substrate formed of Si, on which electrothermal elements as heaters, and ejection orifices, have been formed by a thin film technology. The electrothermal elements and ejection orifices will be described later in detail. On this element substrate 2, a plurality of ejection orifices are aligned in two parallel lines, so that the ejection orifices 4 in one line are displaced by half a pitch from the ejection orifices 4 in the other lines, in the line direction, like footprints of a bird, as shown in FIG. 1, (*a*). The element substrate 2 is fixed to a portion of an L-shaped supporting member 102 with glue. Also fixed to the supporting member 102 is a wiring substrate 104, the wiring on which is electrically connected to the wiring on the element substrate 2 by bonding. The supporting member 104 is formed of aluminum in view of processability. A referential character 103 designates a molded member, into which the supporting member 102 is partially inserted to be supported by the molded member 103. The molded member 103 comprises a liquid supply path 107, through which liquid (for example, ink) is supplied from a liquid storing portion (unillustrated) to the ejection orifices with which the aforementioned element substrate 2 is provided. Further, the molded member 103 functions as a member which plays a role in removably installing the entirety of a liquid ejecting head in accordance with the present invention into a liquid ejecting apparatus, and removably fixing it to the liquid ejecting apparatus. The liquid ejecting apparatus will be described later in detail.

The element substrate 2 comprises a connective path 105, which penetrates through the element substrate 2, and through which the liquid supplied through the liquid supply path 107 of the molded member 103 is supplied to the ejection orifices. The connective path 105 is connected to liquid paths leading to ejection orifices, one for one, and also functions as a common liquid chamber.

Figure 2:
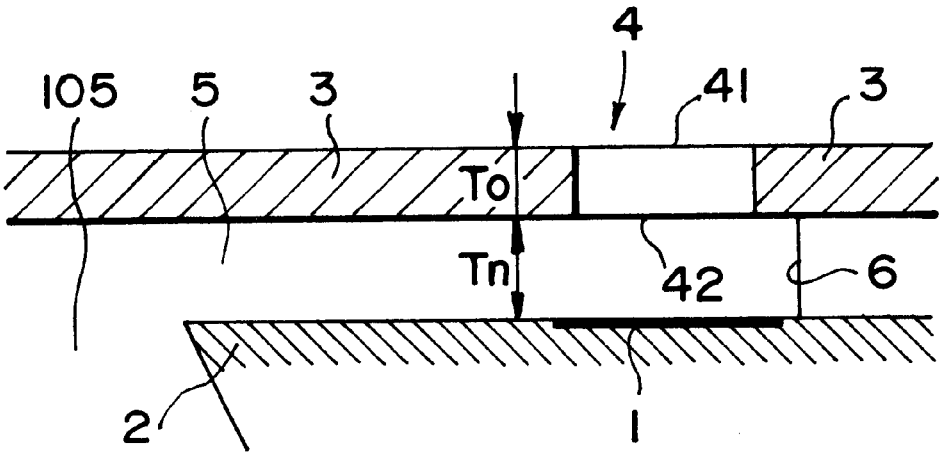
FIG. 2, (*a*) is a vertical section of the essential portions, that is, one of the ejection orifices and one of the liquid paths, of the liquid ejecting head in FIG. 1.
Figure 2:
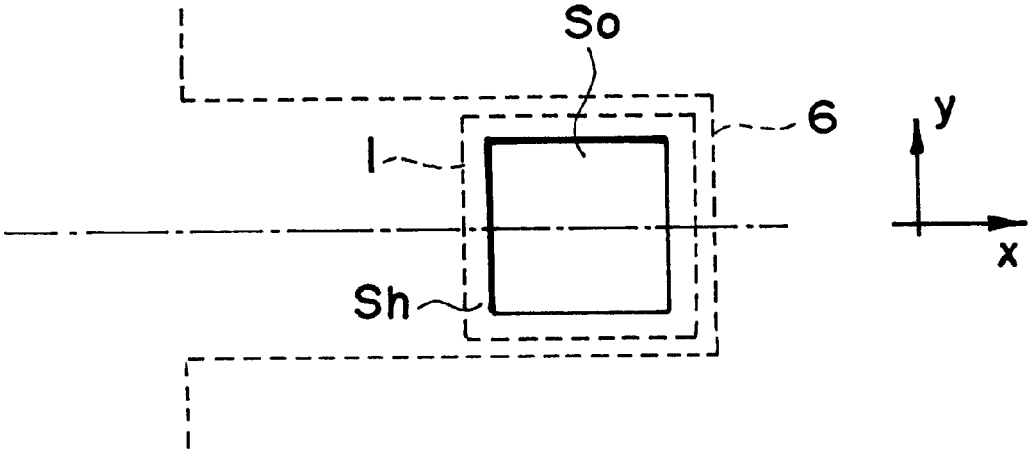

FIG. 2, (*a*) is a vertical section of the essential portions, that is, the ejection orifice and the liquid path, of the liquid ejecting head in FIG. 1. FIG. 2, (*b*) is a top view of the essential portion of the liquid ejecting head illustrated in FIG. 2, (*a*).

As illustrated in FIG. 2, the liquid ejecting head in accordance with the present invention is provided with rectangular electrothermal elements as heaters 1, which are disposed at predetermined locations, one for one, on the element substrate 2. Above the heaters 1, an orifice plate 3 is disposed. The orifice plate 3 is provided with rectangular ejection orifices 4, which directly face the center portions of the heaters 1, one for one. The size of the opening of the ejection orifice 4 is designated by a referential code So as can be seen in FIG. 2, (*b*). Referential characters 41 and 42 designate the top and bottom "surfaces" of the ejection orifice 4. In this embodiment, the top and bottom "surfaces" are imaginary surfaces: the imaginary surfaces formed by extending the top and bottom surfaces of the orifice across the top and bottom openings of the ejection orifice 4.

Referring to FIG. 2, (*a*), the gap between the heater 1 and the orifice plate 3 equals the height Tn of the liquid path 5, and is determined by the height of a liquid path wall 6. Referring to FIG. 2, (*b*), in which the liquid path 5 extends in the direction indicated by an arrow mark X, the ejection orifices 4 which are in connection to the liquid paths 5 one for one are aligned in a plurality of parallel lines perpendicular to the direction X. The plurality of liquid paths 5 are connected to the connective path 105, in FIG. 1, (*b*), which also functions as a common liquid chamber. The thickness of the orifice path 3, which equals the distance between the imaginary top and bottom surfaces 41 and 42 of the ejection orifice, is designated by a referential character To.

Next, an embodiment of the liquid ejecting method in accordance with the present invention, which uses a liquid ejecting head with the above described structure, will be described.

Figure 3:
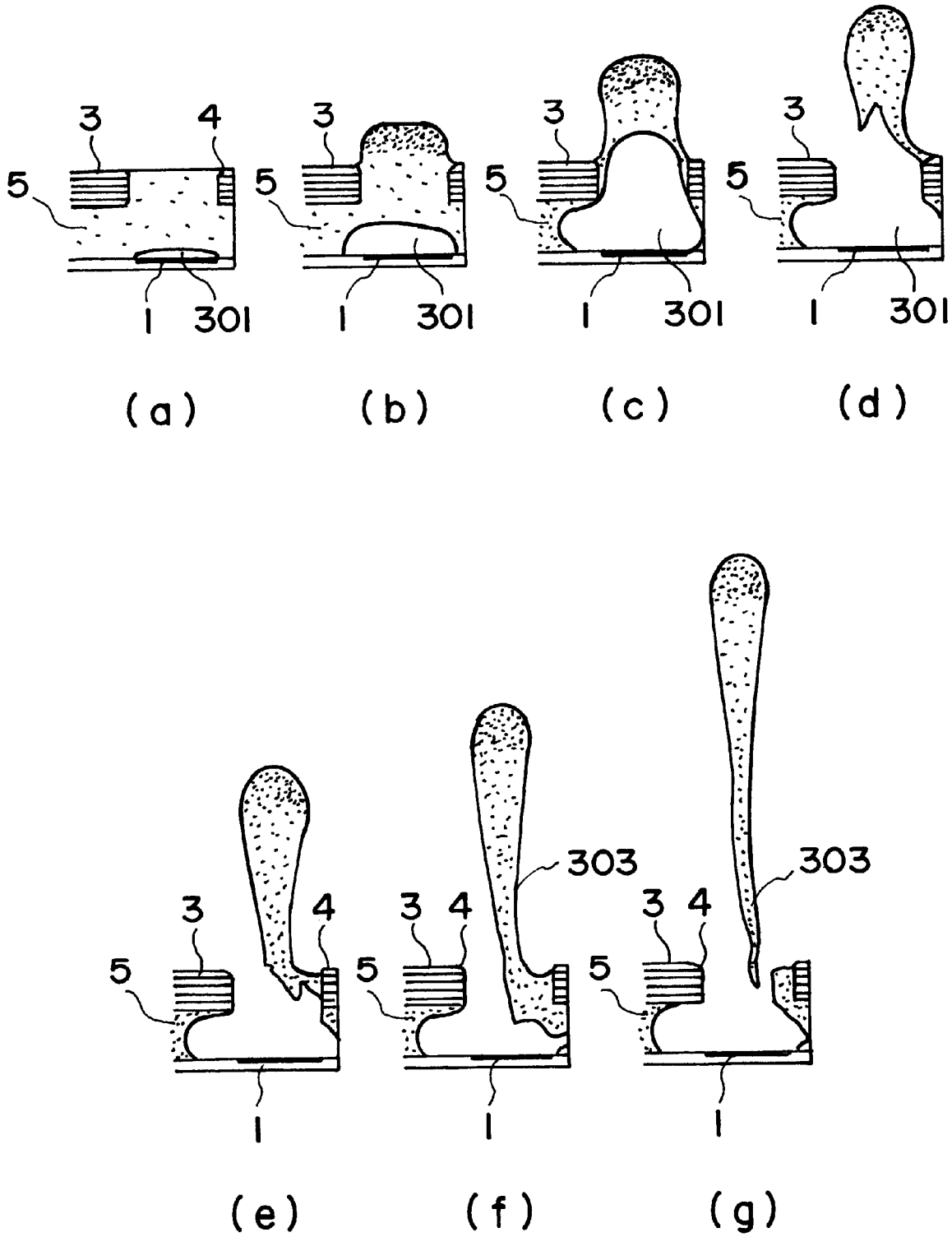
FIG. 3, (*a*)–(*g*), are sections of the essential portions of the liquid ejecting head to which the liquid ejecting method in accordance with the present invention is applicable, and depict the operational steps of the head.

FIG. 3, (*a*)–(*g*), are sections of the essential portions of the liquid ejecting head to which the liquid ejecting method in accordance with the present invention is applicable. They depict the operational steps of the head.

Referring to FIG. 3, (*a*), in the normal state, a meniscus 11 is at the top end of the ejection orifice. In this state, driving voltage is applied to the heater 1. The heater 1 is desired to be driven with the use of short pulses so that the meniscus is prevented from being excessively retracted by the excessive bubble growth. The duration of the electrical pulse applied to the heater 1 to eject liquid is desired to be no more than 3.5 μsec. This is due to the following reason. If the pulse duration is greater than 3.5 μsec., bubble growth becomes excessive, which makes the location of the meniscus after the liquid ejection excessively far from the ejection orifice. As a result, refilling time becomes longer, which makes the liquid ejecting head unsuitable for high speed recording. It is possible to use a multi-pulse driving method, that is, a driving method which applies two or more pulses per ejection. In such a case, the duration of the pre-pulse, that is, the pulse applied prior to the application of the main pulse for recording liquid ejection, is desired to be no more than 1.5 μsec. The interval between the pre-pulse and the main pulse is desired to be no more than 2.0 μsec. If the duration of the pre-pulse exceeds 1.5 μsec, and/or the interval between the pre-pulse and the main pulse exceeds 2.0 μm, bubble growth becomes excessive, which in turn causes the meniscus to retract by a greater distance. The greater retraction of the meniscus makes it impossible for the liquid ejection head to eject liquid at a high frequency; in other words, it makes the objects of the present invention impossible to accomplish.

The proper driving voltage value for accomplishing the objects of the present invention is 1.1 to 1.3 times the threshold voltage Vth for liquid ejection. If the driving voltage is no more than 1.1 times the threshold voltage Vth, liquid ejection velocity is excessively low, causing liquid droplets to be ejected off the predetermined course, provided that bubbles are generated and liquid droplets are ejected. Also, liquid ejection becomes instable at a high frequency. On the contrary, if the driving voltage value is no less than 1.3 times the threshold voltage Vth, bubble length becomes excessive, causing the meniscus to retract by a greater distance, which in turn prolongs refilling time, and/or excessively increases liquid ejection velocity, increasing the amount of the splash which occurs as a liquid droplet hits the recording medium. Thus, the aforementioned driving voltage range is one of the desirable conditions for the present invention.

Next, referring to FIG. 3, (*b*), as driving voltage is applied to the heater 1, a bubble 301 is caused to grow in the liquid, in contact with the heater 1. Then, as the bubble 301 grows, the liquid in the ejection orifice 4 and liquid paths 5 on the top side of the bubble 301 swells upward from the top end of the ejection orifice 4. During this process, the pressure of the bubble 301, which has been greater than the atmospheric pressure, begins to drop below the atmospheric pressure.

Next, referring to FIG. 3, (*c*), as the bubble grows further, the liquid in the ejection orifice 4 and liquid path 5 on the top side of the bubble 301 is ejected upward from the top end of the ejection orifice 4. At this stage, however, the bubble 301 has not become connected to the atmosphere, and the meniscus in the liquid path 5 keeps retracting due to the further growth of the bubble 301. Immediately before the bubble 301 becomes connected to the atmosphere, the front end of the recording liquid, in terms of liquid flow, in the liquid path 5 is still at the imaginary bottom surface 42 of the ejection orifice 4, and also is in connection with the recording liquid remaining on the internal surface of the ejection orifice 4. The internal pressure of the bubble 301 remains below the atmospheric pressure until the bubble 301 becomes connected to the atmosphere. If the bubble 301 becomes connected to the atmosphere while the internal pressure of the bubble 301 is equal to, or above, the atmospheric pressure, the instable liquid adjacent to the ejection orifice 4 is caused to splash at the time of the connection between the bubble 301 and the atmosphere. Further, there is no force which works to pull the instable liquid back into the liquid path, and therefore, the instable liquid adjacent to the ejection orifice 4 cannot be prevented from splashing.

Next, referring to FIG. 3, (*d*), at the same time or immediately after the bubble 301 becomes connected to the atmosphere, the liquid droplet 12 is ejected from the ejection orifice 4, and leaves the top edge of the ejection orifice 4. At this moment when the liquid droplet leaves the top edge of the ejection orifice 4, if the separation of the liquid droplet from the liquid in the ejection orifice 4 occurs on the left-hand side, in the drawing, of the ejection orifice 4, the major portion of the aforementioned recording liquid which remains on the internal surface of the ejection orifice is pulled down by the recording liquid which is remaining at the aforementioned imaginary bottom surface 42 of the ejection orifice, and eventually joins with the recording liquid within the liquid path 5, that is, returns to the liquid path 5. The meniscus 11 retracts farthest slightly after the connection between the bubble 301 and the atmosphere. After this point, the liquid droplet is ejected as shown in FIG. 3, (*e*)–(*g*). Then, the recording liquid refills the ejection orifice 4, and stabilizes.

Regarding the above described processes, as long as the liquid which retains within the ejection orifice after the connection between the bubble and the atmosphere remains in connection with the liquid which retracts into the liquid path from the ejection orifice, and this liquid remaining within the ejection orifice is caused to join with the liquid within the liquid path and eventually refill the ejection orifice, even if recording liquid is adhering adjacent to the imaginary top surface of the ejection orifice, this liquid joins with the aforementioned recording liquid which is adhering to the internal surface of the ejection orifice. In other words, even this liquid, which is adhering adjacent to the imaginary top surface of the ejection orifice, is moved back into the liquid path 5, the aforementioned phenomenon that the recording liquid fails to be ejected does not occur, that is, the recording liquid is reliably ejected.

The volume by which liquid is ejected as the liquid droplet 12 is determined by the ejection orifice size or the like of a liquid ejecting head used for liquid ejection. In the case of the liquid ejecting head in this embodiment, the volume of the liquid droplet 12 is made to be no more than $15\times10^{-15}$ $m^3$.

One of the desirable conditions for allowing the bubble 301 to reliably become connected to the atmosphere is: $To+Tn \leqq$ heater size. The heater size means $Sh^{1/12}$, in which Sh stands for the size of the heating surface of the heater.

If $To+Tn \geqq Sh^{1/2}$, the greater the value of (To+Tn) in relative terms, the more likely are the factors responsible for the connection between the bubble and the atmosphere to negatively work in terms of the balance in the connection, even if the bubble becomes connected to the atmosphere. Therefore, a proper relation between (To+Tn) and $Sh^{1/2}$ becomes the desirable condition. In addition, if $To+Tn \geqq Sh^{1/2}$, the recording liquid is ejected without allowing the bubble to become connected to the atmosphere. In other words, one of the prerequisites of the present invention does not exist.

The structural features of a liquid ejecting head described below are listed as the embodiments of the present invention which assure that the aforementioned liquid, which remains within a nozzle after the connection between a bubble and the atmosphere, remains in connection with the aforementioned liquid which retracts from the ejection orifice into the liquid path, and that this liquid remaining in contact with the liquid having retracted from the ejection orifice joints with the liquid within the liquid path, and refills the nozzle.

(1) An ejection orifice is more effective if its vertical section is tapered, that is, the minimum distance across the aforementioned imaginary top surface of the ejection orifice through the center of the top surface is shorter than the minimum distance across the aforementioned imaginary bottom surface of the ejection orifice through the center of the bottom surface.

Figure 6:
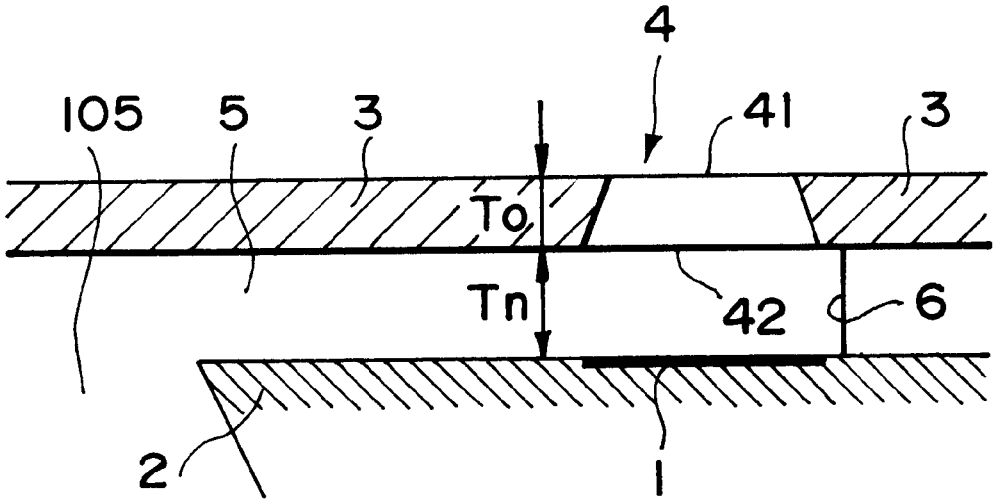
FIG. 6 is a section of a liquid ejecting recording head in accordance with the present invention, and depicts the vertically tapered shape of the ejection orifice.

FIG. 6 depicts the vertical section of an ejection orifice with the above described vertical section. Since the ejection orifice is tapered, it is geometrically easier for the recording liquid remaining on the internal surface of the ejection orifice to remain in connection with the ink within the liquid path. Further, since the size of the imaginary bottom surface of the ejection orifice is greater than the imaginary top surface of the ejection orifice, it is more difficult for the recording liquid to plug the ejection orifice.

(2) An ejection orifice is more effective if its horizontal section is in the form of a star rather than in the form of a circle or a square. In other words, the easier it is for the recording liquid to remain on the internal surface of the ejection orifice, the easier it is for the aforementioned processes to occur. This is due to the following reason. That is, if the horizontal section of an ejection orifice is in the form of a "star", it is easier for recording liquid, which is adhering to the top portion of the ejection orifice, to remain in connection to the liquid at the bottom portion of the ejection orifice, and also, the effective horizontal size of the ejection orifice at the time of liquid ejection is determined by the size of the area surrounded by the lines which connect the adjacent inward corners of the star.

(3) Meniscus curvature

In order to make it easier for the liquid remaining on the internal surface of an ejection orifice to join with the liquid within the liquid path, the negative pressure which the meniscus formed in the liquid path generates is desired to be as large as possible. In order for the meniscus to generate a greater amount of negative pressure, it is desired that the liquid path is as small as possible in height and cross section, as long as refilling time does not excessively increase.

In order to enhance the desirable embodiments (1)–(3), it is particularly desirable that the bottom side of an ejection orifice is rendered easier to be wetted by recording liquid (orifice is treated so that it becomes hydrophilic).

(4) Volume of liquid adhering to ejection orifice

In order to prevent recording liquid from plugging an ejection orifice, it is desirable that control is executed so that the amount of liquid which remains at the top portion of the ejection orifice, that is, the amount of excessive liquid, becomes as small as possible. In order to do so, it is important that the top portion of the ejection orifice is treated to give it hydrophobicity, so that small patches of liquid which are adhering to the top portion of the internal surface of the ejection orifice are prevented from joining with each other and growing. In other words, it is important that the top portion of the internal surface of the ejection orifice is rendered as water repellent as possible. Further, it is effective for hydrophilic regions to be located away from the water repellent top portion of the ejection orifice.

Next, the factors which determine how liquid is ejected from the above described liquid ejecting head will be described in more detail from the standpoint of orifice plate configuration.

The liquid which remains on the internal wall of an ejection orifice after recording liquid ejection forms a meniscus within the ejection orifice. At this moment, the relative pressure P of the recording liquid is:

$$P=-\gamma(1/r1-1/r2)$$

$$r1<r2\rightarrow P<0$$

$$r1>r2\rightarrow P>0,$$

in which r1 stands for ½ of the minimum distance across the meniscus formed in the ejection orifice, through the center of the meniscus, as seen from above; r2 stands for the radius corresponding to the curvature of the meniscus (curvature of the section of the meniscus, at a plane which is parallel to a liquid path, and contains the center of the meniscus); and γ stands for the surface tension of the recording liquid. The ejection orifice is less likely to be plugged with the recording liquid when P>0, because even if recording liquid is present adjacent to the imaginary top surface of the ejection orifice, this liquid is more difficult to pull into the ejection orifice when P>0.

The value of r1 is proportional to ejection orifice diameter ($\approx So^{1/2}$), and the value of r2 is proportional to the thickness To.

Based on the above described relation, the inventors of the present invention tested various liquid ejecting heads produced in consideration of the structural requirements which prevents the aforementioned phenomenon that an ejection orifice is plugged with recording liquid, that is, the requirement regarding the minimum distance across the horizontal cross section of the ejection orifice through the center of the cross section, and the orifice plate thickness. As a result, it was discovered that even if the liquid within the liquid path is not in contact with the imaginary bottom surface of the ejection orifice immediately after the connection between a bubble and the atmosphere, the ratio at which the aforementioned phenomenon, or the plugging of the ejection orifice by the recording liquid occurs, drastically differs across a point at which the minimum distance across the horizontal section of the ejection orifice through the center of the section is twice the orifice plate thickness. That is, when the minimum distance across the horizontal section of the ejection orifice through the center of the section is twice the orifice plate thickness or greater (if the distance between the imaginary top and bottom surfaces of the ejection orifice is no more than half the minimum distance across the horizontal section of the ejection orifice through the center of the section), the ratio at which the aforementioned phenomenon occurs is extremely low. On the contrary, if the minimum distance across the horizontal section of the ejection orifice through the center of the section is no more than the twice the orifice plate thickness (if the distance between the imaginary top and bottom surfaces of the ejection orifice is no less than half the minimum distance across the horizontal section of the ejection orifice through the center of the section), the ratio at which the aforementioned phenomenon occurs is extremely high, that is, high enough to create problems in terms of practical usage.

In the present invention, if the aforementioned horizontal section of an ejection orifice, which is perpendicular to the direction in which recording liquid is ejected, is substantially in the form of a true circle, "the minimum distance across the horizontal section of the ejection orifice through the center of the section" can be defined as the diameter of the virtually circular horizontal section of the ejection orifice. If the horizontal section of the ejection orifice is square, it can be defined as the length of one of the four sides; if rectangular, it can be defined as the length of the shorter side; if oval, it can be defined as the length of its shortest diameter; and if the vertical section of an ejection orifice, parallel to the ejecting direction, has a tapered shape, it can be defined as the minimum distance across the ejection orifice through the center of the ejection orifice.

Next, the conditions required to drive a liquid ejecting head at a high frequency will be described. In order to drive a liquid ejecting head at a high frequency, refilling time must be short. Refilling time is determined by (1) the maximum amount of meniscus retraction, (2) capillary force as the force for driving the liquid for refilling, and (3) viscous resistance of the liquid path during refilling.

The smaller the maximum amount of meniscus retraction (2), the shorter the refilling time. Thus, the amount of meniscus retraction is desired to be as small as possible as long as liquid droplets with a desirable volume are reliably ejected. In order to satisfy this requirement, it is desirable that the duration of a driving pulse is set to be no more than 3.5 $\mu$sec.

The capillary force (2) is the force which drives ink during refilling, and therefore, generally speaking, it is desired to be as large as possible. In other words, the surface tension of recording liquid is desired to be as high as possible, preferably, no less than 0.025 N/m.

Generally speaking, the viscous resistance of a liquid path (3) is desired to be as small as possible.

The above described conditions are for the purpose of making it easier for the aforementioned liquid within the liquid path to remain in connection to the liquid which remains on the internal surface of an ejection orifice. Therefore, when these conditions are satisfied, a liquid ejecting head in accordance with the present invention can more reliably eject recording liquid.

It should be noted here that the capillary force (2) and the viscous resistance (3) of a liquid path must be set so that the meniscus vibration does not become excessively large after the completion of refilling.

Regarding a condition which reduces the viscous resistance of the liquid path during refilling to a practical level at which a liquid ejecting head in accordance with the present invention can be driven at a high frequency, it is discovered that the height Tn of the liquid path must be 6 $\mu$m or more; 6 $\mu$m$\leqq$Tn. If 6 $\mu$m$\geqq$Tn, that is, if the height of the liquid path is excessively reduced, the viscous resistance of the liquid path excessively increases, prolonging refilling time, and therefore, the liquid ejecting head cannot be driven at high frequency. In order to keep the viscous resistance of the liquid path low, it is necessary to employ recording liquid, the viscosity of which is not excessively high. In other words, the viscosity of the recording liquid is desired to be no more than $5\times10^{-2}$ N/s.

In order to print an image desirable in terms of the distortion, that is, an image which is small in the amount of distortion, the velocity at which liquid droplets are ejected is desired to be no less than 10 m/sec and no more than 30 m/sec, preferably, no less than 10 m/sec and no more than 20 m/sec. If the velocity at which liquid droplets are ejected is less than 10 m/sec, liquid droplets are likely to miss the intended spots on the recording medium, which is possible to reduce print quality. If the ejection velocity exceeds 30 m/sec, the ejected liquid droplets are likely to splash and form mist as they hit the recording medium. Further, even if the above described condition regarding the liquid ejection velocity is satisfied, if the thickness of the orifice plate is excessively reduced, it is possible that the direction in which liquid droplets are ejected becomes instable, and also that the mechanical strength of the orifice plate 3 is reduced. Thus, the orifice plate needs to have a certain amount of thickness. More specifically, the thickness of the orifice plate needs to be no less than 4 $\mu$m.

Figure 4:
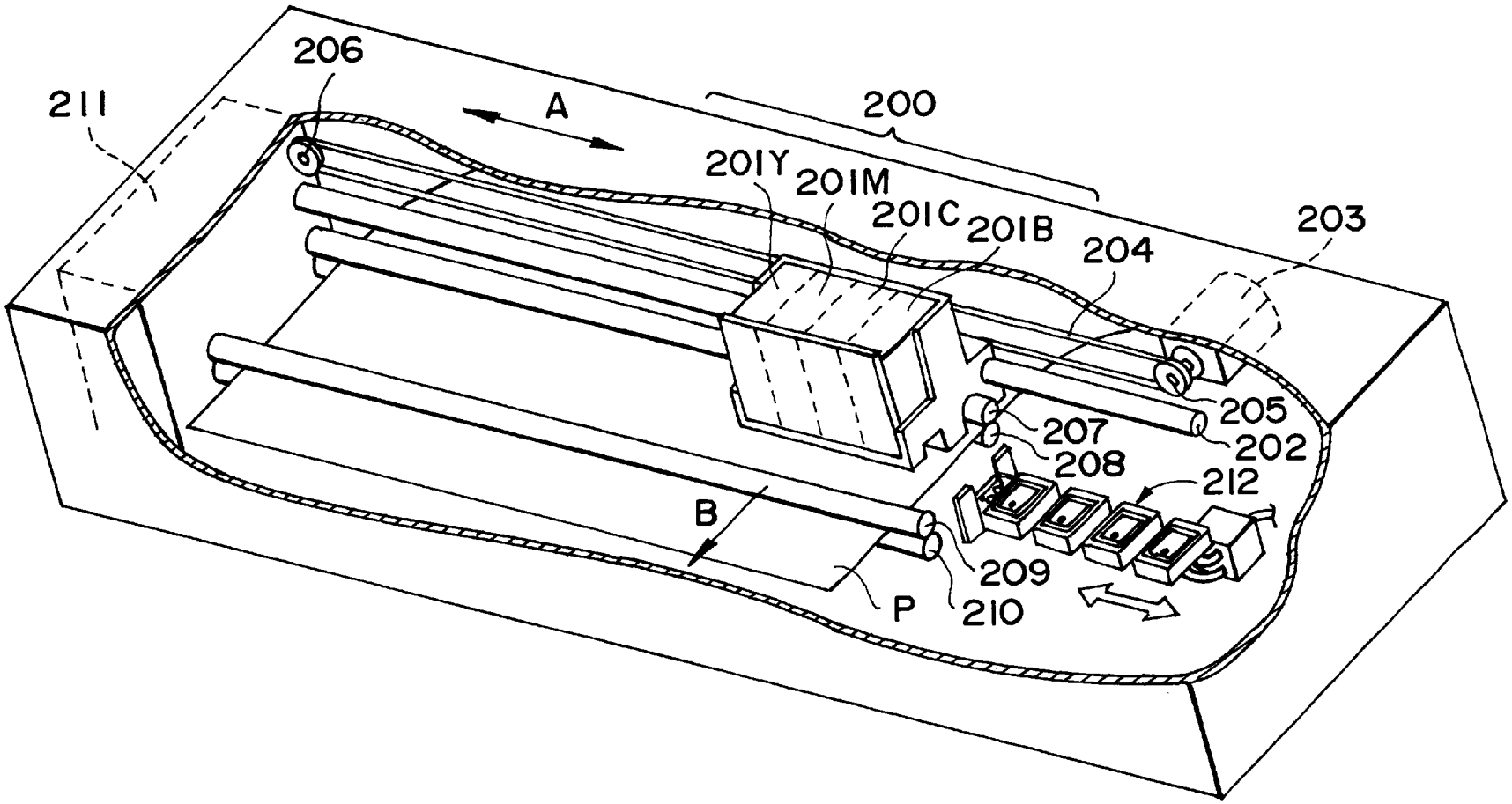
FIG. 4 is a partially broken perspective view of an example of a liquid ejecting apparatus compatible with a liquid ejecting head to which the liquid ejecting method in accordance with the present invention is applicable, and depicts the general structure thereof.
Figure 5:
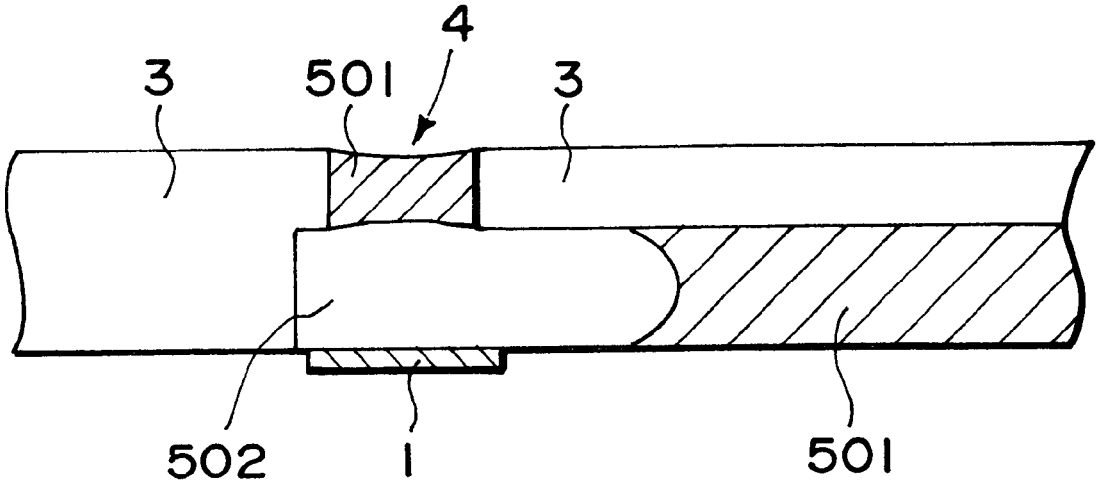
FIG. 5 is an enlarged section of the essential portion of a liquid ejection head in accordance with the present invention, and depicts the problem which is solved by the present invention.

A liquid ejecting head in accordance with the above described embodiments of the present invention, can be mounted in a liquid ejecting apparatus, for example, the one illustrated in FIG. 4, to practice the liquid ejecting method in accordance with the present invention.

Next, an example of a liquid ejecting apparatus will be described with reference to FIG. 4.

Referring to FIG. 4, a referential character 200 designates a carriage on which the aforementioned liquid ejecting head is removably mounted. In this liquid ejecting apparatus, four liquid ejecting heads are employed to accommodate inks of different colors, and are mounted on the carriage 200, along with an ink container 201Y for yellow ink, an ink container 202M for magenta ink, an ink container 201C for cyan ink, and an ink container 201B for black ink.

The carriage 200 is supported by a guide shaft 202, and is enabled to shuttle along the guide shaft 202, by an endless belt 204 driven forward or backward by a motor 203. The endless belt is wrapped around pulleys 205 and 206.

A sheet of recording paper P as recording medium is intermittently conveyed in the direction indicated by an arrow mark B, which is perpendicular to the direction A. The recording paper P is held by being pinched by the upper pair of rollers 207 and 208, and the bottom pair of rollers 209 and 210, being thereby given a certain amount of tension so that it remains flat while being conveyed. The roller units are driven by a driving section 211. However, the apparatus may be structured so that the roller units are driven by the aforementioned motor.

The carriage 200 stops at the home position at the beginning of each printing operation, and also as necessary. At the home position, capping members 212 for capping the four heads one for one are located. The capping members 212 are connected to vacuuming means, which prevents ejection orifices from being clogged, by vacuuming the ejection orifices.

(Embodiments 1 and 2)

The liquid ejecting head illustrated in FIG. 2, (*a*) and (*b*), was produced, and its performance was tested. The results are given in Table 1. The ejection orifices were aligned in two parallel lines, the ejection orifices in one line being displaced in the line direction half a pitch from the ejection orifices in other line, as shown in FIG. 1, (*a*) and (*b*). More specifically, in each line, the ejection orifices are disposed at a pitch of 300 dpi, and the ejection orifices in one line are displaced by 25.4 mm in line direction, from ejection orifices in the other line. In other words, the ejection orifices are arranged like the footprints of a bird. Consequently, the ejection orifice density in the direction perpendicular to the primary scanning direction of the head became 600 dpi (600 ejection orifices per 25.4 mm). The minimum distance across the horizontal section of the ejection orifice through the center of the section was 22 $\mu$m, and the ejection orifices were shaped so that their horizontal sections became square. The size So of the opening of each ejection orifice was 484 $\mu m^2$ (=22 $\mu$m×22 $\mu$m). With this specification, the length of the effective bubble generating region in the liquid flow direction was 26 $\mu$m, and the distance from the center of the effective bubble generating region to the edge of the effective bubble generating region, on the liquid supply source side, was 13 $\mu$m. The size of the heating surface of each heater was 936 $\mu m^2$ (=26 $\mu$m×36 $\mu$m).

In Embodiments 1 and 2, the height Tn of the liquid flow path was made to be 12 $\mu$m and 6 $\mu$m, respectively, and the thickness To of the orifice plate was made to be 9 $\mu$m and 11 $\mu$m, respectively. Further, across the surface of each heater, a 0.6 $\mu$m thick electrically insulative film ($SiO_2$) and a 0.3 $\mu$m thick passivation film (Ta) were formed.

As for recording ink, the ink with the following composition was used:

| | |
|---|---|
| TiO glycol | 15% |
| Glycerin | 5% |
| Urine | 5% |
| Isopropyl alcohol | 4% |
| Water | remainder |

The ink had a viscosity of $1.8\times10^{-2}$, a surface tension of 0.038 N/m, and a density of 1040 kg/m$^3$.

The liquid ejecting head (recording head) structured as described above was driven at 7 kHz with the use of a power source which could apply a voltage Vop of 12 V to the heater. The duration of the driving pulse was set to be 1.9 $\mu$sec. When the duration of the driving pulse applied to the heater was 1.9 $\mu$sec, the minimum voltage Vth (threshold voltage) necessary for the ink to be ejected was 9.9 V. Therefore, Vop/Vth was 1.21. The performance, or characteristic, regarding various aspects of this head, which was realized when the head was driven under the above described condition, is given in Table 1.

TABLE 1

| | Emb. 1 | Emb. 2 | Comp. 1 | Comp. 2 | Comp. 3 | Comp. 4 |
|---|---|---|---|---|---|---|
| Sh ($\mu m^2$) | 936 | ditto | ditto | ditto | ditto | ditto |
| So ($\mu m^2$) | 484 (22 $\mu$m × 22 $\mu$m) | ditto | ditto | ditto | 441 (21 $\mu$m × 21 $\mu$m) | 484 (22 $\mu$m × 22 $\mu$m) |
| D ($\mu$m) | 22 | ditto | ditto | ditto | 21 | 22 |
| Tn ($\mu$m) | 12 | 6 | 6 | 4 | 6 | 5.5 |
| To ($\mu$m) | 9 | 11 | 12 | 9 | 11 | 11 |
| Stability | good | good | no good | no good | no good | no good |
| Vol. ($10^{-18}$ m$^3$) | 8.2 | 7.7 | 7.5 | 7.2 | 7.4 | 7.9 |
| Speed (m/s) | 15.8 | 17.3 | 18.0 | 19.1 | 17.7 | 17.8 |
| Refilling time ($\mu$sec) | 75 | 129 | 146 | 280 | 127 | 159 |
| Properly continued to | 170 | 6 | 0.2 | 0.4 | 0.7 | 0.2 |
| D/To | 2.44 | 2.0 | 1.83 | 2.44 | 1.91 | 2.0 |

Under the above described conditions, a printing operation was carried out, in which a plurality of A3 size sheets or recording paper were continuously fed. The minimum cross distance D of an ejection orifice through the center of the orifice was 22 $\mu$m, which was no less than twice the orifice plate thickness To which equaled the distance between the imaginary top and bottom surfaces of the ejection orifice. The performance was such that printing could be carried out across the entire surface of an A3 sheet of recording paper or more, without an interruption, which exceeded a performance level above which there would be no problem in practical usage. In other words, the head was reliable.

The head was fast enough in ink ejection velocity to deal with a situation in which ink viscosity had increased while the head was left unused. More specifically, the head could desirably deal with ink, the viscosity of which was as high as $5\times10^{-1}$ poise. When the ink viscosity increased beyond $10\times10^{-1}$ poise, that is, when the ink viscosity was excessively high, ink ejection velocity dropped below 10 m/sec. As a result, ink droplets missed intended spots on the recording medium. In order to assure that the object of the present invention is accomplished, the surface tension of ink is desired to be as high as possible. However, the surface tension of the ink must be determined in consideration of how an ink droplet behaves as it hits the recording medium, in addition to the ink ejection velocity. Thus, the surface tension of ink is desired to be no less than $30\times10^{-2}$ N/m, and there is no restriction regarding the upper limit as long as the ink can be desirably ejected by a bubble. If the surface tension of the ink is less than $30\times10^{-2}$ N/m, the capillary force generated by the ink is not high enough to serve as the force for driving the ink for refilling. Therefore, refilling time is long, and long refilling time makes it impossible for the head to be driven at a high frequency, which is a problem.

In the above embodiments, the refilling time was 75 μsec, counting from the beginning of the liquid ejection pulse application. The meniscus vibration thereafter was at an undetectable level, and had virtually no effect upon printing quality.

Also in those embodiments, the heater protection film was rendered thin, and the pulse duration was set short. Consequently, the amount of bubble growth was relatively small. In other words, the refilling time was reduced by reducing the amount of meniscus retraction, instead of increasing refilling speed.

Further, the protective layer for the heater 1 was formed of $SiO_2$ (0.6 μm thick), and passivation film (0.3 μm thick) was formed of Ta. These films are desired to be as thin as possible, provided that heater durability is reasonably long. Reducing the thickness of the protective layer makes it possible to reduce the overall amount of the thermal energy conducted from a heater to the ink between the beginning of the pulse application and the beginning of bubble growth. Therefore, reducing the thickness of the protective layer reduces the amount of bubble growth after bubble generation, reducing consequently the amount of meniscus retraction. When the protective layer is formed of $SiO_2$ or SiN, its thickness is desired to be no more than 1 μm. Obviously, if extremely non-corrosive platinum or the like material is used as heater material, the protective layer may be eliminated.

In the liquid ejecting heads in accordance with the present invention, in which a bubble generated in a liquid path becomes connected to the atmosphere through an ejection orifice, the volume by which ink is ejected per ejection is generally determined by the geometric aspects of the heater, liquid path, and ejection orifice. In other words, there is a wide range in the amount of bubble growth, in which the volume by which ink is ejected per ejection is not affected by the reduction in bubble growth.

(Comparative Examples 1–4)

The liquid ejecting heads employed in Comparative Examples 1–4 are the same as those employed in Embodiments 1 and 2, except that in these comparative examples, the height of the liquid path was varied from the those in Embodiments 1 and 2. In other words, in Embodiments 1 and 2, the height Tn of the liquid path was 12 μm and 6 μm, whereas in Comparative Examples 1–4, it was 6 μm, 4 μm, 6 μm and 5.5 μm, correspondingly. In Comparative Examples 1–4, the thickness To of the orifice plate was 12 μm, 9 μm, 11 μm, and 11 μm, correspondingly, and the minimum distance across the opening of each ejection orifice through the center of the orifice was less than twice the orifice plate thickness To.

In Comparative Examples 1 and 3, in which the orifice plate thickness To, which was set to be equal to the distance between the imaginary top and bottom surfaces of each ejection orifice, was greater than half the minimum distance D across the opening of the ejection orifice through the center of the opening, the liquid ejecting head frequency failed to eject the liquid, or the ink. In Comparative Examples 2 and 4, in which the height of the liquid path was less than 6 μm, refilling time was so long that the liquid ejecting head was not suitable for high frequency driving.

Although this is not recorded in Table 1, if the value of (To+Tn) is greater than $Sh^{1/2}$ (≈31 μm), the behaviors of a liquid droplet and a meniscus become instable at the time when the bubble becomes connected to the atmosphere, which negatively affects print quality.

(Embodiments 3–5 and Comparative Examples 5–10)

The liquid ejecting head illustrated in FIG. 2, (*a*) and (*b*), was produced, and its performance was tested. The results are given in Table 2. The ejection orifices were aligned in two parallel lines as shown in FIG. 1, (*a*) and (*b*). More specifically, in each line, the ejection orifices were disposed at a pitch of 600 dpi, and the ejection orifices in one line were displaced by half a pitch, in line direction, from ejection orifices in the other line. In other words, the ejection orifices were arranged like the footprints of a bird. Consequently, the ejection orifice density in the direction perpendicular to the primary scanning direction of the head became 1200 dpi. The size of the opening of each ejection orifice in Embodiments 3–5 was 227 $\mu m^2$, (=ϕ17 μm), 225 $\mu m^2$ (=15 μm square), and 234 $\mu m^2$. In each of Embodiments 3–5, the size Sh of the heating surface of each heater was 576 $\mu m^2$ (24 μm×24 μm).

In Embodiments 3–5, the same ink as the one employed in Embodiments 1 and 2 was employed.

As for the height Tn of each liquid path, it was made to be 12 μm in Embodiments 3 and 4, and 6 μm in Embodiment 5 . As for the thickness To of the orifice plate, it was made to be 7 μm in Embodiment 3, and 6 μm in Embodiment 4. In Embodiment 5, it was made to be 9 μm.

In Comparative Examples 5–10, the size So of each ejection orifice was made to be 220 $\mu m^2$, 314 $\mu m^2$, 227 $\mu m^2$, 202 $\mu m^2$ (14.2 μm square), 324 $\mu m^2$, and 324 $\mu m^2$, correspondingly. The size Sh of the heating surface of each heater was made to be the same as that for Embodiments 3–5, which was 570 $\mu m^2$ (24 μm×24 μm). The height Tn of each liquid path in Comparative Examples 5–10 was made to be 12 μm, 4 μm, 8 μm, 12 μm, 6 μm and 5.0 μm, correspondingly, and the thickness To of each orifice plate was made to be 9 μm, 11 μm, 9 μm, 9 μm, and 9.5 μm, and 9 μm, correspondingly.

The sheet resistance of the heater was 53 ohm.

The liquid ejecting head (recording head) structured as described above was driven at 10 kHz with the use of a power source which could apply a voltage Vop of 9.0 V to the heater. The duration of each driving pulse was set to be 2.7 μsec. When the duration of driving pulse applied to the heater was 2.7 μsec, the minimum voltage Vth (threshold voltage) necessary for the ink to be ejected was 7.2 V. Therefore, Vop/Vth was 1.25. The performance, or characteristic, regarding various aspects of this head, which was realized when the head was driven under the above described condition (9 V/2.7 μsec), and the number of consecutive recording sheets (A3 sheets of recording paper) through the printing of which ink was normally ejected, are given in Table 2.

TABLE 2

| | Emb. 3 | Comp. 5 | Comp. 6 | Comp. 7 | Comp. 8 | Emb. 4 | Emb. 5 | Comp. 9 | Comp. 10 |
|---|---|---|---|---|---|---|---|---|---|
| Sh ($\mu m^2$) | 576 (≧$\mu$m × 24 $\mu$m) | ditto | ditto | ditto | ditto | ditto | ditto | ditto | ditto |
| So ($\mu m^2$) | 227 | 200 | 314 | 227 | 202 (14.2 $\mu$m × 14.2 $\mu$m) | 225 (15 $\mu$m × 15 $\mu$m) | 324 | ditto | ditto |
| D ($\mu$m) | ø7 | ø16 | ø20 | ø17 | 14.2 | 15 | ø18 | ditto | ditto |
| Tn ($\mu$m) | 12 | 12 | 4 | 8 | 12 | 12 | 6 | 6 | 5 |
| To ($\mu$m) | 7 | 9 | 11 | 9 | 9 | 6 | 9 | 9.5 | 9 |
| Stability | good | no good | no good | no good | no good | good | good | no good | no good |
| Vol. ($10^{-18}$ $m^3$) | 4.5 | 4.3 | 4.2 | 4.1 | 4.4 | 4.2 | 4.8 | 4.9 | 4.1 |
| Speed (m/s) | 17 | 15 | 18 | 14 | 15 | 17.5 | 16 | 16 | 18 |
| Refilling time ($\mu$sec) | 92 | 90 | 920 | 95 | 89 | 86 | 102 | 101 | 158 |
| Properly continued to | 110 | 0.1 | 0.05 | 0.2 | 0.05 | 110 | 5 | 0.8 | 0.3 |
| D/To | 2.4 | 1.78 | 1.82 | 1.89 | 1.58 | 2.5 | 2.0 | 1.89 | 2.0 |

As is evident from Table 2, in Embodiments 3–5, the number of the consecutive recording sheets, through the printing of which the ink was normally ejected, was far greater than that in the comparative examples. This verifies that the present invention successfully prevented the appearance of unwanted white lines, which would have appeared if some of the ejection orifices failed to eject ink.

Paying attention to D/To, in Embodiments 3–5, D/To was no less than 2, whereas in Comparative Examples 5–9, it was no more than 2. Further, in Comparative Examples 5–9, the number of the consecutive recording sheets, through the printing of which ink was normally ejected, was small, and also, the unwanted white lines for which ejection failure is responsible were conspicuous. Thus, D/To is desired to be no less than 2. In Comparative Example 10, D/To was 2.0, and the frequency of sudden ejection failure was relatively small. However, in this Comparative Example 10, the height Tn of each liquid path was 5.0 $\mu$m, which was rather low. Therefore, when the head was driven at a frequency of 10 kHz or higher, the liquid path could not be refilled fast enough, and therefore, an image lighter in color than a normal image was printed. In other words, the number of consecutive recording sheets through the printing of which ink was normally ejected was small.

As for refilling time, in Comparative Example 7, it was 95 $\mu$sec, which was fast enough to drive the head at the aforementioned frequency. However, in Comparative Example 6, it was 920 $\mu$sec, which was not fast enough for the driving frequency of 10 kHz. This is due to the fact that in Comparative Example 6, Tn was 4 $\mu$m, which was rather small. Thus, as long as refilling time is concerned, the height Tn is desired to be no less than 6 $\mu$m.

In Embodiment 4 and Comparative Example 8, the opening of each ejection orifice was square, which was different from the shapes of the openings in other embodiments and comparative examples, in which they were in the form of a true circle. Even in Comparative Example 6 in which the shape of the opening of the ejection orifice was truly circular, the sudden ejection failure occurred just as in the other heads, the openings of the ejection orifices of which were truly circular. In Embodiment 4, D/To was 2.5, which was desirable since it was greater than 2. Even though the opening of the ejection orifice was square, the sudden ejection failure did not occur. In consideration of the deformation caused by the pressure generated by bubbles, the thickness To of the orifice plate is desired to be no less than 4 $\mu$m.

Further, in order to accurately evaluate the aforementioned embodiments and comparative examples in terms of color density and sudden ejection failure, the liquid ejecting head was activated so that each sheet of recording paper was "solidly" covered with ink, and the results were evaluated. Being "solidly" covered means that the printable area of each sheet of recording paper is covered 100% by ink dots. In this test, a plurality of A3 size (JIS) sheets of recording paper were consecutively fed. What was important as a criterion for evaluating the liquid ejecting heads was whether or not a liquid ejecting head could normally eject ink to solidly cover the entirety of at least one of the consecutively fed sheets of recording paper, with ink. If color density begins to drop, or sudden ejection failure occurs (head is not acceptable), while a given liquid ejecting head is used to cover the entirety of a sheet of recording paper with ink, this head is judged to be impractical, because in such a case, the printing operation must be interrupted to carry out a recovery operation or the like, which requires extra time. In other words, it is essential that it is assured that a liquid ejecting head can entirely cover at least one sheet (A3 size) of recording paper with ink, without an interruption and without losing print quality.

In any case, the present invention offers practical solutions, in terms of liquid ejecting head structure and liquid ejecting method, to the problems which occur when ink droplets with a volume of no more than $15\times10^{-15}$ $m^3$ are ejected from such a liquid ejecting head that allows bubbles to become connected to the atmosphere.

(Miscellaneous)

The present invention brings forth excellent results when applied to an ink jet based recording head and an ink jet based recording apparatus, in particular, those which are equipped with means (for example, electrothermal transducer, laser beam emitting element, and the like) for generating thermal energy as the energy used for ejecting ink, and change the state of ink with the use of the thermal energy. This is due to the fact that according to such an ink jet system, recording can be made at a high density to produce highly precise images.

As for the structures and liquid ejection principle for such a recording head or a recording apparatus, those disclosed in the specifications of U.S. Pat. Nos. 4,723,129 and 4,740,796 are desirable. The system disclosed in these patents is compatible with both the so-called on-demand type and the continuous type, in particular, the on-demand type for the following reason. That is, in the on-demand type, each electrothermal transducer is disposed so that it faces a sheet or a liquid path in which liquid (ink) is held. In order to eject the liquid, at least one signal, which is capable of generating a large enough amount of thermal energy to suddenly increase liquid temperature to a point at which the so-called film boiling is triggered in the liquid, on the surface of the electrothermal transducer, is applied to the electrothermal transducer in accordance with recording data. In other words, bubbles are formed in the liquid (ink) by driving signals one for one. As each bubble grows and contracts, the liquid is ejected in the form of a droplet (at least one droplet) through the opening of specific ejection orifices correspondent to the recording data. The driving signal is preferred to be in the form of a pulse, because the driving signal in the form of a pulse causes a bubble to instantly and properly grow and contract, in other words, head response is excellent when the driving signal is in the form of a pulse.

More specifically, a driving signal such as the driving signal in the form of a pulse which is disclosed in U.S. Pat. Nos. 4,463,359 and 4,345,262 is suitable. Further, if the condition regarding the rate of temperature increase at the heat releasing surface of an electrothermal transducer, which is recorded in the specification of U.S. Pat. No. 4,313,124 is employed, printing quality can be further improved.

The present invention is compatible with not only the recording head structure disclosed in each of the specifications of the aforementioned patents, in which ejection orifices, liquid path (right angle liquid path), and electrothermal transducers are arranged as described above, but also recording heads such as the recording head structure disclosed in the specifications of U.S. Pat. Nos. 4,558,333 and 4,459,600, according to which the heat releasing surface of an electrothermal transducer is located at the bend of a liquid path. The present invention is also effective when applied to the recording head structure disclosed in Japanese Laid-Open Patent Application No. 123670/1984, according to which an ejection orifice is constituted of a slit shared by a plurality of electrothermal transducers, or the recording head structure disclosed in Japanese Laid- Open Patent Application No. 138461/1984, according to which an opening for absorbing pressure waves generated by thermal energy is placed directly facing the liquid ejecting section. In other words, the present invention improves a recording head, such as those described above, in terms of reliability and efficiency, regardless of its configuration.

Further, the present invention is effectively applicable to a full-line type recording head, that is, a recording head, the length of which equals the maximum recording range of a recording apparatus, that is, the width of the image recordable area of the largest piece of recording medium which can be accommodated by a recording apparatus. A full-line recording head may be constituted of a combination of a plurality of recording heads, the combined length of which equals the length of the full-line recording head, or may be formed as a single piece of a long recording head.

The present invention is also effectively applicable to the aforementioned serial type recording head, which may be in the form of a fixed type recording head, a chip type recording head, or a cartridge type recording head. A fixed type recording head is such a head that is fixed to the main assembly of a recording apparatus. A chip type recording head is an exchangeable type head, which is removably installable in the main assembly of a recording apparatus. As it is installed in the main assembly of a recording apparatus, it is electrically connected to the main assembly, and is provided with ink. A cartridge type recording head is such a head that integrally comprises an ink container.

Providing a recording head with an ejection performance restoring means, a means for ejecting liquid prior to recording ejection, and the like means, is desirable since it assures the effectiveness of the present invention. More specifically, these means are a means for capping a recording head, a means for cleaning a recording head, a means for applying positive or negative pressure to a recording head, a means for heating a recording head or ink prior to recording ejection, and a means for ejecting ink prior to recording ejection. A means for heating a recording head or ink prior to recording ejection may employ an electrothermal transducer for recording ejection, an electrothermal transducer different from the one for recording ejection, or a combination of both.

Regarding the recording head type, and the number of recording heads mounted in a recording apparatus, there is no strict restriction. For example, the number of recording heads mounted in a recording apparatus may be only one as it is in the case of a recording apparatus which prints only in the monochromatic mode, or may be plural as it is in the case of a recording apparatus which uses a plurality of inks to print images different in color or density. In other words, the present invention is very effectively applicable to not only a recording apparatus equipped with only a single recording head for the main printing mode, or black mode, but also a recording apparatus equipped with a plurality of recording heads, being integral with each other or separate, for printing in a plurality of recording modes, for example, a multi-color mode, a full color mode accomplishable by color mixture, and the like mode inclusive of the monochromatic mode.

In the above description of the embodiments of the present invention, ink was described as ink in liquid form. However, the present invention is compatible with such ink that remains solid at or below the normal room temperature and liquefies above the normal room temperature. Generally speaking, in an ink jet system, in order to keep ink viscosity within a range in which ink ejection remains stable, ink temperature is controlled so that it remains within a range from no less than 30° C. to no more than 70° C. Thus, the ink to be used with a recording head in accordance with the present invention may be such ink that liquefies at the time of recording signal application. Using the "solid" ink offers additional benefits. For example, the excessive temperature increase, which will be caused by the excessive energy, can be prevented by using the excessive energy to change the state of ink from solid state to liquid state. Ink which remains solid when left alone, and liquefies as heat is applied to it may be employed to prevent ink evaporation. In any case, the present invention is compatible with any of the inks of the above described types, for example, the solid ink which is liquefied only by the thermal energy generated by a recording signal, and is ejected in liquid form, but begins to solidify the moment it reaches recording medium. One example of such ink is disclosed in Japanese Laid-Open Patent Application No. 56847/1979 or 71260/1985, according to which the ink in solid or liquid state is retained in the indentations or through holes of a sheet of porous material, so that it directly faces an electrothermal transducer. In terms of compatibility with this type of ink, a recording head based the aforementioned film-boiling type system is the best.

As for the field of usage, an ink jet type recording apparatus in accordance with the present invention can be used as an image output terminal for an information processing device such as a computer, a copying apparatus combined with a reader or the like, a facsimile machine provided with both sending and receiving functions, or the like.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method using a liquid ejecting head, said method comprising:

generating thermal energy sufficient to create bubbles in liquid using electrothermal transducer elements, providing ejection outlets disposed opposed to the electrothermal transducer elements, the ejection outlets being arranged at a density not less than 300 per 25.4 mm in a line, providing liquid flow paths in fluid communication with the ejection outlets, bringing the bubbles generated by the thermal energy generated by the electrothermal transducer element into communication with ambience while an internal pressure of each of the bubbles is less than an ambient pressure, ejecting droplets having volumes not more than $15\times10^{-15}$ $m^3$ at a frequency not less than 7 kHz, wherein the liquid flow paths each have a height not less than 6 $\mu$m, and a distance between an upper surface and a lower surface of each of the ejection outlets is not more than one half of a minimum opening distance through a center of each of the ejection outlets.

2. A method according to claim 1, wherein a sum of the distance between the upper surface and the lower surface of the ejection outlet and the height of the liquid flow path is not more than a size of the electrothermal transducer element.

3. A method according to claim 1, wherein a volume of the droplet is not more than $10\times10^{-15}$ $m^3$.

4. A method according to claim 1, wherein the height of the liquid flow path is not more than 20 $\mu$m.

5. A method according to claim 1, wherein an ejection speed of the ejected droplet is not more than 20 m/s.

6. A method according to claim 1, wherein a width of an electrical pulse applied to said electrothermal transducer element to eject the liquid is not more than 3.5 $\mu$sec.

7. A method according to claim 1, wherein a driving voltage of an electrical pulse applied to the electrothermal transducer element is in a range of 1.1 times to 1.3 times a threshold voltage of liquid droplet ejection.

8. A method according to claim 7, wherein said electrical pulse comprises a plurality of pulses.

9. A method according to claim 8, wherein said plurality of pulses include a main pulse and a pre-pulse applied before the main pulse, and a duration of the pre-pulse is not more than 1.5 $\mu$sec.

10. A method according to claim 9, wherein an interval between said pre-pulse and said main pulse is not more than 2.0 $\mu$sec.

11. A method according to claim 1, wherein the liquid to be ejected has a surface tension not less than 0.025 N/m and a viscosity not more than $5\times10^{-1}$ poise.

12. A method according to claim 1, wherein said electrothermal transducer element generates enough thermal energy to cause film boiling of the liquid.

13. A liquid ejecting head comprising:

electrothermal transducer elements for generating thermal energy sufficient to create bubbles in liquid, ejection outlets disposed opposed to the electrothermal transducer elements, the ejection outlets being arranged at a density not less than 300 per 25.4 mm in a line, and liquid flow paths in fluid communication with the ejection outlets, wherein the bubbles generated by the thermal energy are brought into communication with ambience while an internal pressure of the bubbles is less than an ambient pressure, droplets having volumes not more than $15\times10^{-15}$ $m^3$ are ejected from the ejection outlets at a frequency not less than 7 kHz, the liquid flow paths each have a height not less than 6 $\mu$m, and a distance between an upper surface and a lower surface of each of the ejection outlets is not more than one half of a minimum opening distance through a center of each of the ejection outlets.

14. A head according to claim 13, wherein a sum of the distance between the upper surface and the lower surface of the ejection outlet and the height of the liquid flow path is not more than a size of the electrothermal transducer element.

15. A head according to claim 13, wherein a volume of the droplet is not more than $10\times10^{-15}$ $m^3$.

16. A head according to claim 13, wherein the height of the liquid flow path is not more than 20 $\mu$m.

17. A head according to claim 13, wherein an ejection speed of the ejected droplet is not more than 20 m/s.

18. A head according to claim 13, wherein a width of an electrical pulse applied to said electrothermal transducer element to eject the liquid is not more than 3.5 $\mu$sec.

19. A head according to claim 13, wherein a driving voltage of an electrical pulse applied to the electrothermal transducer element is in a range of 1.1 times to 1.3 times a threshold voltage of liquid droplet ejection.

20. A head according to claim 19, wherein said electrical pulse comprises a plurality of pulses.

21. A method according to claim 20, wherein said plurality of pulses include a main pulse and a pre-pulse applied before the main pulse, and a duration of the pre-pulse is not more than 1.5 $\mu$sec.

22. A method according to claim 21, wherein an interval between said pre-pulse and said main pulse is not more than 2.0 $\mu$sec.

23. A method according to claim 13, wherein the liquid to be ejected has a surface tension not less than 0.025 N/m and a viscosity not more than $5\times10^{-1}$ poise.

24. A method according to claim 13, wherein said electrothermal transducer element generates enough thermal energy to cause film boiling of the liquid.

25. A liquid ejecting method using a liquid ejecting head having electrothermal transducer elements for generating thermal energy sufficient to create bubbles in liquid and ejection outlets disposed opposed to the electrothermal transducer elements which are arranged at a density not less than 300 per 25.4 mm in a line, the liquid ejection head also having liquid flow paths in fluid communication with the ejection outlets, respectively, wherein the bubble generated by the thermal energy generated by the electrothermal transducer element is brought into communication with ambience while an internal pressure of the bubble is less than an ambient pressure, and wherein droplets having volumes not more than $15\times10^{-15}m^3$ are ejected at a frequency not less than 7 kHz, said method comprising:

a first step, wherein liquid remaining in the ejection outlet after fluid communication with the ambience of the bubble maintains fluid communication with liquid retracted from the ejection outlet in the liquid flow path;

a second step, wherein the liquid remaining in the ejection outlet and the liquid retracted from the ejection outlet in the liquid flow path are merged to refill the liquid into the ejection outlet; and a third step of repeating said first and second steps to eject droplets having volumes not more than $15\times10^{-15}m^3$ at a frequency not less than 7 kHz.

26. A method according to claim 25, wherein a sum of the distance between an upper surface and a lower surface of the ejection outlet and a height of the liquid flow path is not more than a size of the electrothermal transducer element.

27. A method according to claim 25, wherein an outer surface in which the ejection outlets are formed is treated to be hydrophobic.

28. A method according to claim 27, wherein an outer surface in which the ejection outlets are formed has a partial hydrophobic region.

29. A method according to claim 25, wherein an inner surface in which the ejection outlets are formed is treated to be hydrophilic.

* * * * *